United States Patent [19]

Fischer et al.

[11] Patent Number: 5,044,240

[45] Date of Patent: Sep. 3, 1991

[54] APPARATUS FOR CONVEYING AND CUTTING A PRODUCT INTO DISCRETE PIECES

[75] Inventors: Robert R. Fischer, Michigan City; Charles E. Rowell, Valparaiso, both of Ind.

[73] Assignee: Urschell Laboratories Incorporated, Valparaiso, Ind.

[21] Appl. No.: 392,573

[22] Filed: Aug. 11, 1989

[51] Int. Cl.[5] ..... B26D 7/06

[52] U.S. Cl. ..... 83/161; 83/431; 83/435.2

[58] Field of Search ..... 83/435.2, 431, 110, 83/857, 858, 161; 198/626.5

[56] References Cited

U.S. PATENT DOCUMENTS 3,109,469 5/1963 Urschel et al. .
3,170,564 2/1965 Gatto ..... 198/626.5
3,850,213 11/1974 Keaton ..... 198/626.5 X
4,230,218 10/1980 Kunzmann ..... 198/626.5 X
4,766,793 8/1988 Fischer et al. .

FOREIGN PATENT DOCUMENTS 2312655 9/1977 Fed. Rep. of Germany ... 198/626.5
2749876 5/1979 Fed. Rep. of Germany ... 198/626.5

*Primary Examiner*—Timothy V. Eley
*Attorney, Agent, or Firm*—Bacon & Thomas

[57] ABSTRACT

An elongate product is divided into a plurality of longitudinal strips by frictionally engaging the product between a pair of spaced flexible conveyors defining a longitudinal feed path therebetween and feeding the product at a desired orientation into a stationary knife assembly which cuts the product into strips that are discharged through a spiral-shaped chute and collected in a receptable. The spacing between the conveyors may be varied by adjustment assemblies spaced longitudinally along the feed path.

14 Claims, 3 Drawing Sheets

APPARATUS FOR CONVEYING AND CUTTING A PRODUCT INTO DISCRETE PIECES

BACKGROUND OF THE INVENTION

1. Field of the Invention

The present invention generally involves the field of technology pertaining to devices and machines for dividing agricultural products into discrete pieces of predetermined size. More specifically, the invention relates to an improved apparatus for cutting elongate vegetables, such as carrots, zucchini, potatoes, celery and the like, into a plurality of longitudinal strips.

2. Description of the Prior Art

Machines for cutting or slicing products particularly agricultural produce, into plural pieces of various shapes and sizes are well known in the art.

A particular type of such machines is conventionally known as a "water gun" or hydraulic cutting system and is particularly useful for cutting potatoes into slabs or strips. A water gun operates by pumping a mixture of water and the product to be cut through a pipe. The product is propelled at a fairly high rate of speed and caused to impact against a stationary knife assembly which cuts the product into the required size portions during its travel through the pipe. The resulting mixture of water and cut product is then discharged for separating the cut product from the water. Water guns are particularly useful in the production of french fries, since they are capable of propelling the water and potato mixture through the knife assembly at a high production rate.

The stationary knife assembly utilized in a typical water gun is defined by a cutting head block onto which a plurality of elongate knife elements are secured in parallel pairs that are disposed in a staggered relationship and at a 90° offset with respect to adjacent pairs of knife elements. The cutting edges of the knife elements collectively define a plurality of rectangular-shaped boxes for producing strips of the product having corresponding transverse crosssectional configurations. The interengagement of adjacent knife elements is accomplished by providing each knife element with at least one open slot in its base portion and at least one open slot in its blade portion so that the blade portion of one knife element may be interengaged within the corresponding base portion of an adjacent knife element. The knife elements disposed at the furthermost upstream end of the head block are only provided with slots in their base portions, while the knife elements disposed at the furthermost downstream end of the head block are only provided with slots in their blade portions. A conventional water gun system utilizing a stationary knife assembly of this type is disclosed by the Fischer et al. U.S. Pat. No. 4,766,793.

Another known apparatus for cutting elongate products lengthwise into separate strips is disclosed by the Urschel et al. U.S. Pat. No. 3,109,469. This apparatus utilizes a single conveyor onto which green or wax beans are fed and longitudinally aligned by a plurality of trough walls. The aligned beans are thereafter conveyed to a rotating knife assembly comprised of a grooved slitting roller and a cooperating bank of circular slitting knives between which the beans are slit into strips.

Conventional systems and machines for dividing elongate products into plural strips are large and expensive, particularly in the case of a water gun system.

They are also complex in design and often do not have the ability to operate at high production capacities.

SUMMARY OF THE INVENTION

It is an object of the present invention to provide an improved apparatus for cutting a product into a plurality of discrete pieces.

It is another object of the invention to provide an improved apparatus for longitudinally dividing elongate agricultural products into a plurality of strips having a desired size and configuration.

It is a further object of the invention to provide an improved machine for cutting a product into longitudinal strips wherein the apparatus is of compact size, simple in construction and economical to manufacture.

It is still an object of the invention to provide an improved apparatus for cutting elongate products into longitudinal strips at a high production rate.

These and other objects of the invention are realized by providing an apparatus comprised of two endless flexible conveyor belts supported on a frame and driven at substantially the same velocity by a common drive motor and pulley system. Each conveyor is supported at its opposite ends by a feed roller and a discharge roller. The conveyors have external transfer services provided with frictional engagement means, with the surfaces being positioned to form a longitudinal feed path therebetween along which a product is caused to travel from a feed throat formed at the feed rollers to a discharge port formed at the discharge rollers. The spacing of the feed path is variable along the length thereof by a plurality of spaced adjustment assemblies which move the belts toward and away from each other. A feed hopper and associated feed chute is positioned at the feed throat for feeding the products between the belts which frictionally grip each product in a desired orientation and convey the product to the discharge port and into a stationary knife assembly in which the product is cut into strips. The cut product is sent from the knife assembly through a spiral-shaped discharge chute for collection in a receptacle.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
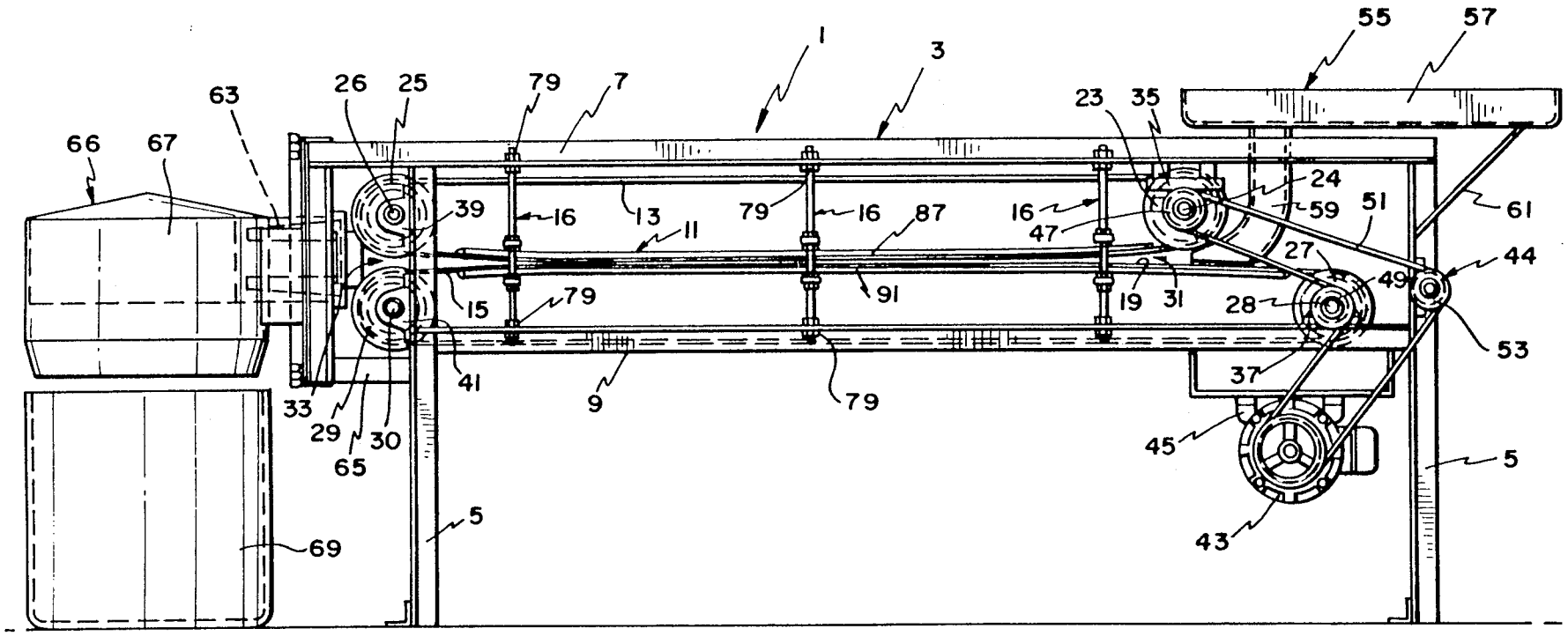
FIG. 1 is a front elevational view of a conveying and cutting apparatus according to a preferred embodiment of the invention.

An apparatus 1 for conveying and cutting a product into a plurality of discrete pieces according to a preferred embodiment of the invention shall now be described with initial reference to FIGS. 1 and 2. Apparatus 1 includes a main support frame 3 that is preferably formed from welded or bolted metal channel or rail sections. Frame 3 includes four vertical leg members 5, a pair of spaced upper longitudinal members 7 and a pair of spaced lower longitudinal members 9.

A product conveying assembly 11 is mounted on frame 3 and includes an upper endless conveyor belt 13, a lower endless conveyor belt 15, and a plurality of longitudinally spaced adjustment assemblies 16 secured between members 7 and 9. Belts 13 and 15 are each of flexible construction and preferably formed from woven nylon fabric impregnated with a plastic polymer material. Belts 13 and 15 include external transfer surfaces 17 and 19, respectively, each of which are provided with frictional engagement means 21 preferably in the form of a pebble configuration. This is more clearly shown in FIG. 2.

Upper belt 13 is supported at its opposite ends by a feed roller 23 mounted on a rotary shaft 24 and a discharge roller 25 mounted on a rotary shaft 26. Similarly, lower belt 15 is supported at its opposite ends by a feed roller 27 mounted on a rotary shaft 28 and a discharge roller 29 mounted on a rotary shaft 30. Belts 13, 15 and their corresponding feed rollers 23, 27 collectively define a feed throat 31 at the intake end of conveying assembly 11, while belts 13, 15 and their corresponding discharge rollers 25, 29 collectively define a discharge port 33 at the output end of assembly 11. Shafts 24 and 28 are supported for free rotation by a pair of roller frames 35 and 37, respectively, mounted on main support frame 3. Similarly, shafts 26 and 30 are supported for free rotation by a pair of roller frames 39 and 41, respectively, mounted on main support frame 3. It is understood that frames 35, 37 and 39, 41 may be of any conventional type deemed suitable for the practice of the invention as disclosed herein.

Figure 2:
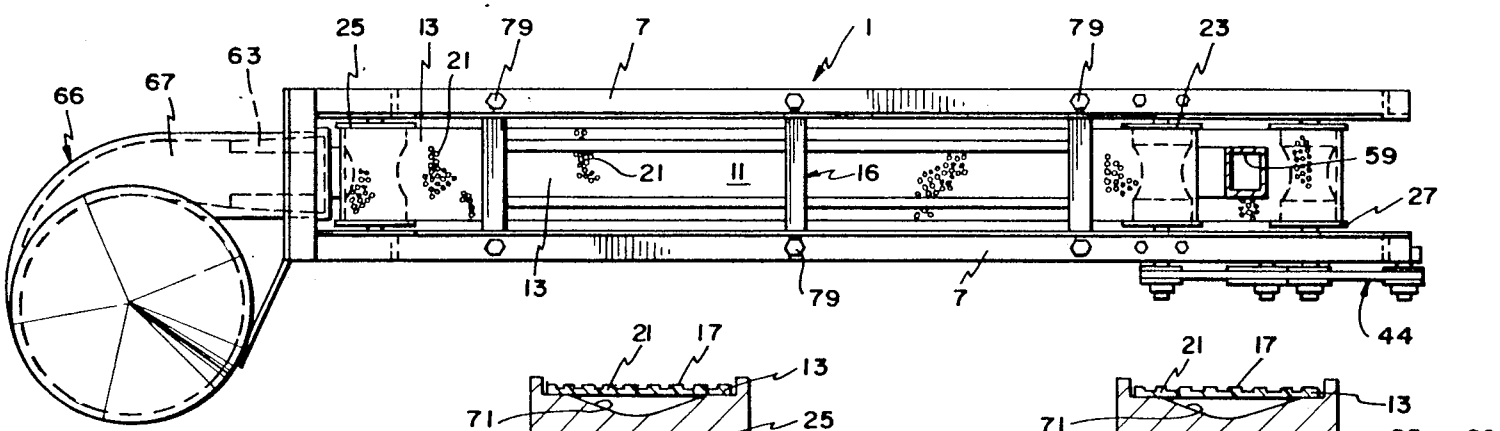
FIG. 2 is a top plan view of the apparatus, but shown without the feed hopper.

A motor 43, preferably electric driven, and provided with a pulley as show in FIG. 1 is mounted on main support frame 3 by a motor frame 45. Motor 43 drives feed rollers 23, 27 through a belt and pulley assembly 44 that includes a pair of pulleys 47, 49 carried on the ends of drive shafts 24, 28, respectively, a flexible drive belt 51 and an idler pulley 53 mounted on frame 3. Operation of motor 43 rotates feed rollers 23 and 27 in opposite directions and at substantially or, preferably, exactly the same speed to thereby drive conveyor belts 13 and 15 at a same corresponding speed. It is understood that motor 43 may be of any conventional size, type and power output deemed suitable for the practice of the invention, and may also be provided with any known control system for varying its output or otherwise controlling its operation.

A product supply and feed assembly 55 is provided adjacent feed throat 31. Assembly 55 includes a feed hopper 57 for storing a supply of products and a feed chute 59 for conveying and directing the individual products into feed throat 31. Assembly 55 is securely attached to main support frame 3 by an appropriate brace means, shown generally at 61. Assembly 55 may be either of an automatic type wherein the individual products are mechanically fed into feed throat 31 or of a manual type wherein the individual products are manually handled and sequentially fed into feed chute 59, depending upon the nature of the product and desired production rate.

A stationary knife assembly, shown generally at 63, is mounted on main support frame 3 by a secondary frame 65. It shall be noted that assembly 63 is positioned directly adjacent the downstream end of discharge port 33 for receiving products conveyed by conveying assembly 11 from feed throat 31 to discharge port 33. Knife assembly 63 is preferably of the type disclosed by the aforementioned Fischer et al. U.S. Pat. No. 4,766,793, the entire disclosure of this patent being incorporated herein by reference. Knife assembly 63 may be of the type utilized in a conventional hydraulic cutting or water gun system and is essentially defined by a cutting head block onto which a plurality of elongate knife elements are secured in parallel pairs that are disposed in a staggered relationship and in a 90° offset with respect to adjacent pairs of knife elements. The cutting edges of the knife elements collectively define a plurality of rectangular-shaped boxes for producing strips of the product having corresponding transverse cross sectional configurations. Knife assembly 63 of this type is highly preferred for the practice of the invention but, it is understood that other forms of knife assemblies, whether stationary or movable, may also be utilized. A rotary knife assembly of the type disclosed by the aforementioned Urschel et al U.S. Pat. No. 3,109,469, the entire disclosure of this patent being incorporated herein by reference, may further be advantageously utilized in the practice of the invention as disclosed herein.

The cut product exiting from knife assembly 63 is directed into a discharge assembly 66 which includes a spiral-shaped chute 67 for providing gradual deceleration of the cut product in order to prevent their breakage. Assembly 66 also includes a receptacle 69 disposed below chute 67 for collecting the cut product.

Figure 4:
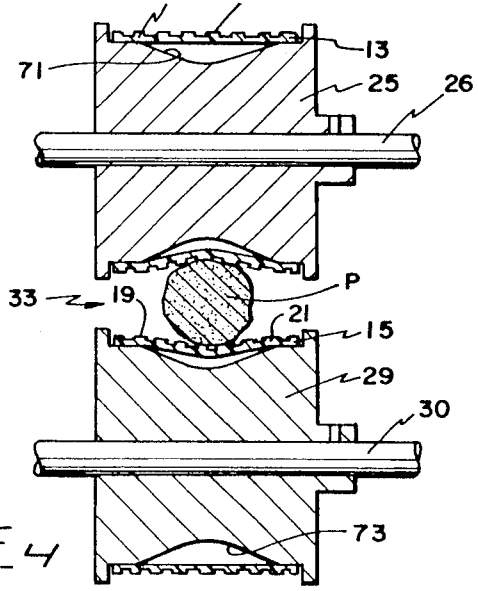
FIG. 4 is a view similar to FIG. 3, but shown with a product frictionally engaged between the conveyor belts and displacing the belts outwardly into corresponding circumferential grooves of the discharge rollers.
Figure 3:
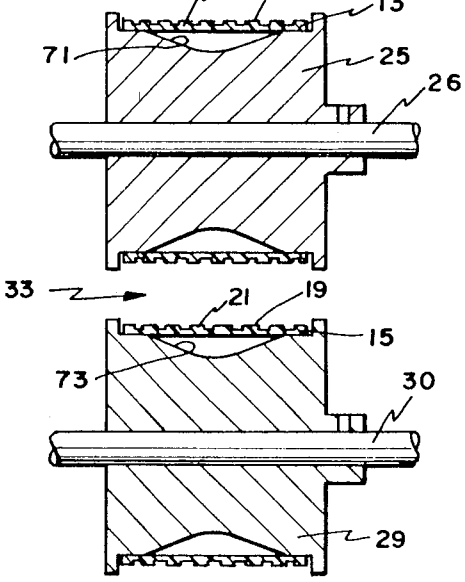
FIG. 3 is a partial vertical cross sectional view showing the discharge rollers and their associated conveyor belts defining the discharge port of the apparatus.

The configuration of discharge rollers 25, 29 and the manner in which they form discharge port 33 with their respective conveyor belts 13, 15 shall now be described with particular reference to FIGS. 3 and 4. As first seen in FIG. 3, rollers 25, 29 are mounted for rotation on their respective shafts 26, 30. Roller 25 is provided with a central circumferential groove 71 that is bridged across the opposite sides thereof by belt 13. Likewise, roller 29 is provided with a correspondingly configured central circumferential groove 73 that is bridged across the opposite sides thereof by belt 15. As is therefore apparent, transfer surfaces 17, 19 define discharge port 33 therebetween, the width of which is established by the distance between shafts 26 and 30. It is preferable to provide roller mounts 39 and 41 with a certain degree of adjustability so that the distance between shafts 26 and 30 may be varied, thereby increasing or decreasing the feed path between surfaces 17 and 19 at discharge port 33 to accommodate different products. With reference to FIG. 4, a product P is shown frictionally engaged between belts 13 and 15. Since the diameter of product P exceeds the spacing between transfer surfaces 17 and 19 defining port 33, belts 13, 15 are caused to be displaced outwardly into their respective grooves 71, 73. This serves to provide a firm frictional grip of product P between belts 13 and 15, maintain its desired orientation, and eject same at a sufficient velocity out discharge port 33 and into knife assembly 63.

Figure 5:
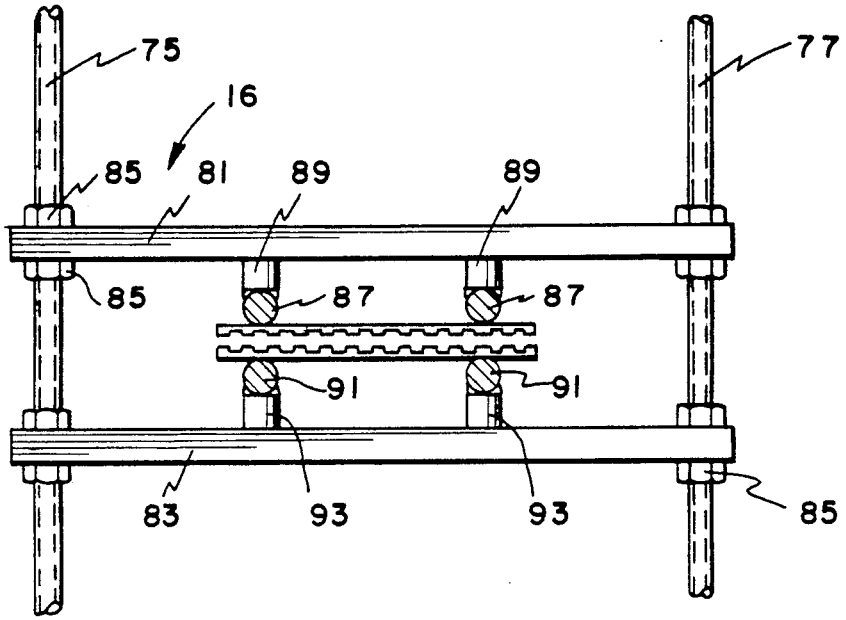
FIG. 5 is a partial vertical cross sectional view showing an adjustment assembly for maintaining a predetermined feed spacing between the transfer surfaces of the conveyor belts.

The manner in which the width of the feed path between belts 13 and 15 along the longitudinal distance from feed throat 31 to discharge port 33 can be varied by adjustment assemblies 16 shall now be described with reference to FIGS. 5 and 6. As seen in FIG. 5, each adjustment assembly 16 includes a pair of vertical support rods 75 and 77 which are secured at their opposite ends to upper and lower longitudinal beams 7 and 9, respectively, of main support frame 3 by means of threaded engagements between rods 75, 77 and a plurality of corresponding nuts 79. A plurality of adjustment assemblies 16 are spaced along the length of conveying assembly 11. This is clearly shown in FIGS. 1 and 2. As also seen in FIG. 5, each adjustment assembly 16 includes an upper cross brace 81 and a lower cross brace 83, the opposite ends of each being provided with apertures for slidable engagement on rods 75 and 77. A plurality of nuts 85 are engaged on corresponding threaded portions of rods 75 and 77 and on opposite sides of braces 81 and 83 to permit the spacing between braces 81 and 83 to be varied and maintained at a desired setting. A pair of upper longitudinal slides 87 are welded to a pair of stubs 89 extending downwardly from upper cross brace 81. A pair of lower longitudinal slides 91 are welded to a pair of stubs 93 extending upwardly from lower cross brace 83. As seen in FIG. 1, slides 87 and 91 are preferably in the form of spaced parallel metal rods which extend for substantially the entire length of conveying assembly 11 between feed throat 31 and discharge port 33. Slides 87 and 91 engage the respective inner surfaces of belts 13 and 15 so that a desired spacing between belts 13 and 15 can be established, as shown in FIG. 5. It is preferred that adjustment assemblies 16 be set so that the spacing between transfer surfaces 17 and 19 causes the feed path to taper gradually from feed throat 31 towards discharge port 33.

Figure 6:
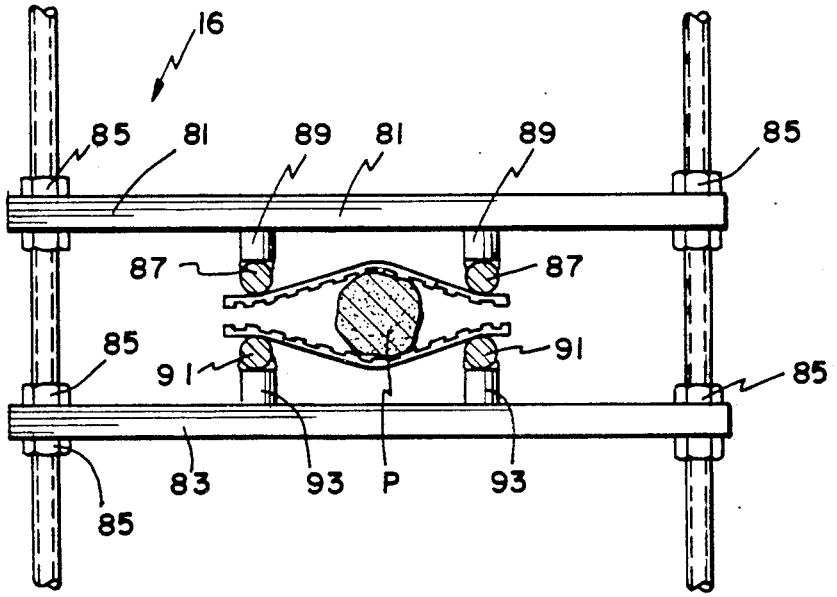
FIG. 6 is a view similar to FIG. 5, but showing a product frictionally engaged between the conveyor belts and displacing the belts in an outward direction.

Since the width of the feed path between transfer surfaces 17 and 19 is set at a distance that is less than the diameter of product P, belts 13 and 15 are caused to flex outwardly so that product P may be securely and frictionally gripped therebetween, as shown in FIG. 6 In this way, the desired orientation of each product P fed into feed throat 31 can be immediately established and maintained along the entire length of conveying assembly 11 so that product P is introduced into knife assembly 63 at the desired orientation. For example, when it is desired to cut elongate agricultural products into strip form, each product is aligned with its longitudinal axis parallel to the direction of product movement from feed throat 31 to discharge port 33. The frictional engagement of belts 13 and 15 against opposite sides of product P maintains this longitudinal orientation as product P exits discharge port 33 and into knife assembly 63. The flexibility of belts 13 and 15, and the pebble configuration 21 of transfer surfaces 17 and 19 provide secure frictional engagement of each product P during its movement along conveying assembly 11. This permits high speed operation of apparatus 1 and a corresponding high production output.

As a preferred example of the invention, apparatus 1 may advantageously be utilized to cut elongate agricultural products, such as carrots, potatoes, zucchini, celery and the like into plural longitudinal strips. Such products may be conveyed by conveying assembly 11 at a velocity of approximately 45 to 75 feet per second through knife assembly 63 of a stationary type. Motor 43, belt and pulley assembly 44 and an appropriate control system should impart a velocity of between approximately 50 to 85 feet per second to belts 13 and 15. It is further preferred that the product be conveyed at a velocity that is approximately ten percent in excess of the minimum velocity required for proper cutting by knife assembly 63 of the stationary type.

It is to be understood that the form of the invention herein shown and described is to be taken as merely a preferred embodiment of the same, and that various changes in shape, material, size and arrangement of parts may be resorted to without departing from the spirit of the invention or scope of the subjoined claims.

We claim:

1. An apparatus for conveying and cutting a product into a plurality of discrete pieces comprising:

a) first and second flexible endless conveyors wherein each conveyor comprises;

i) a feed roller;

ii) a discharge roller defining a circumferential groove; and, iii) a single flexible endless belt operatively passing over the feed roller and the discharge roller, the belt having opposite lateral edge portions, b) means supporting the conveyors in a spaced disposition to define a longitudinal feed path between the conveyor belts the feed path including a feed throat and discharge port;

c) means for varying the spacing between the conveyors along the length of the feed path such that the distance between corresponding lateral edge portions of the first and second conveyor belts is less than a corresponding dimension of the product such that a portion of the conveyor belts is displaced outwardly by the product placed between the conveyor belts thereby causing the product to be frictionally gripped by the conveyor belts;

d) means for simultaneously driving the conveyors at substantially the same speed whereby a product fed into the feed throat is frictionally gripped and maintained between the conveyors in a fixed orientation and conveyed along the feed path towards the discharge port; and e) cutting means for receiving the product from the discharge port in the fixed orientation and dividing the product into a plurality of discrete pieces.

2. The apparatus of claim 1 further including a feed assembly for storing a supply of products and feeding same into the feed throat.

3. The apparatus of claim 2 wherein the feed assembly includes a feed hopper for storing the products and a feed chute for directing each product to the feed throat.

4. The apparatus of claim 1 further including a discharge assembly for receiving and collecting the discrete pieces from the cutting means.

5. The apparatus of claim 4 wherein the discharge assembly includes a spiral-shaped discharge chute and a storage receptacle.

6. The apparatus of claim 1 wherein the means for simultaneously driving the conveyors includes an electric motor, pulley means carried by each of the first and second feed rollers, and a flexible drive belt for driving the feed rollers at substantially the same speed during operation of the motor.

7. The apparatus of claim 1 wherein the means for varying the spacing between the conveyors includes:

a) a first pair of longitudinal slides disposed in engagement against the lateral edge portions of the first conveyor;

b) a second pair of longitudinal slides disposed in engagement against the lateral edge portions of the second conveyor; and, c) means for moving the two pairs of longitudinal slides towards and away from each other, and maintaining the pairs of slides at a fixed spacing.

8. The apparatus of claim 7 wherein the means for moving the slides and maintaining same at a fixed spacing includes:

a) a plurality of adjustment assemblies longitudinally spaced along the feed path; and b) each adjustment assembly including a pair of spaced support rods, first and second cross braces slidably mounted on the support rods and supporting the first and second pairs of slides, respectively, and means for maintaining the cross braces in fixed positions on the support rods.

9. The apparatus of claim 8 wherein the means for maintaining the cross braces in fixed positions includes each support rod being provided with a threaded portion and a plurality of adjustable nuts threadedly engaged on the support rods on opposite sides of each cross brace

10. The apparatus of claim 1 further including:

a) a main support frame; and b) means supporting the first and second feed conveyors on the main support frame to define a substantially horizontal feed path.

11. The apparatus of claim 1 wherein the cutting means includes a stationary knife assembly.

12. The apparatus of claim 11 wherein the stationary knife assembly is defined by a cutting head block and a plurality of elongate knife elements secured to the block in parallel pairs, wherein the parallel pairs of knife elements are disposed in a staggered relationship and at a 90° offset with respect to adjacent pairs of knife elements.

13. The apparatus of claim 1 wherein the first and second conveyors include means for frictionally engaging the product.

14. The apparatus of claim 13 wherein the first and second conveyors are each formed of woven nylon fabric impregnated with a plastic polymer and the frictional engagement means includes a pebble configuration on each conveyor.

* * * * *